US008509678B2

(12) United States Patent
Baumgartner

(10) Patent No.: US 8,509,678 B2
(45) Date of Patent: Aug. 13, 2013

(54) METHOD AND SYSTEM OF ACTIVATING DISPLAY OF MULTIMEDIA DATA ON A MOBILE DEVICE

(75) Inventor: Frederick M. Baumgartner, Elizabeth, CO (US)

(73) Assignee: QUALCOMM Incorporated, San Diego, CA (US)

( * ) Notice: Subject to any disclaimer, the term of this patent is extended or adjusted under 35 U.S.C. 154(b) by 558 days.

(21) Appl. No.: 12/041,516

(22) Filed: Mar. 3, 2008

(65) Prior Publication Data

US 2009/0221229 A1 Sep. 3, 2009

(51) Int. Cl.
*H04H 40/00* (2008.01)

(52) U.S. Cl.
USPC ..... 455/3.06; 455/574

(58) Field of Classification Search
USPC ..... 455/3.06, 456.6, 556.1
See application file for complete search history.

(56) References Cited

U.S. PATENT DOCUMENTS

2003/0093790 A1 5/2003 Logan et al.
2007/0028262 A1 2/2007 Bucher et al.
2007/0136753 A1 6/2007 Bovenschulte et al.
2007/0266403 A1 11/2007 Ou et al.
2009/0197524 A1 8/2009 Haff et al.

FOREIGN PATENT DOCUMENTS

JP 2004534978 A 11/2004
JP 2005250738 A 9/2005

OTHER PUBLICATIONS

International Preliminary Report on Patentability, PCT/US2009/033853, International Preliminary Examining Authority, European Patent Office, Apr. 7. 2010.
International Search Report, PCT/US2009/033853, International Searching Authority, European Patent Office, Sep. 7, 2009.
Written Opinion, PCT/US2009/033853, International Searching Authority, European Patent Office, Sep. 7, 2009.

*Primary Examiner* — Tu X Nguyen
(74) *Attorney, Agent, or Firm* — The Marbury Law Group, PLLC

(57) ABSTRACT

Embodiments include methods and systems for activating display of content items on a mobile device based on event criteria associated with a profile of a user. For example, one embodiment comprises a method of activating reception of multimedia data on a mobile device. The method includes receiving metadata identified with at least a portion of one of plurality of broadcasts, determining, based on the metadata identified with the portion of broadcast content, whether the portion contains event metadata satisfying event criteria associated with a profile of a user, and instructing a receiver of a mobile device of the user to tune to the broadcast for receipt of the portion of the broadcast.

24 Claims, 5 Drawing Sheets

SELECT DESIRED EVENTS:

NEWS
- LIVE EVENTS
  - CAR CHASES
  - NATURAL DISASTERS
  - POLITICAL EVENTS
- REPORTS
  - CELEBRITIES *[ENTER NAMES]*
- WEATHER *[ZIP CODE]*
  - ADVISORIES
  - FORECASTS
    - TODAY
    - 5 DAY
    - SKI FORECAST
    - SURF FORECAST

SPORTS
- LIVE EVENTS
  - GOLF
  - NFL
  - COLLEGE FOOTBALL
  - BASEBALL
- SCORES

300

*FIG. 3*

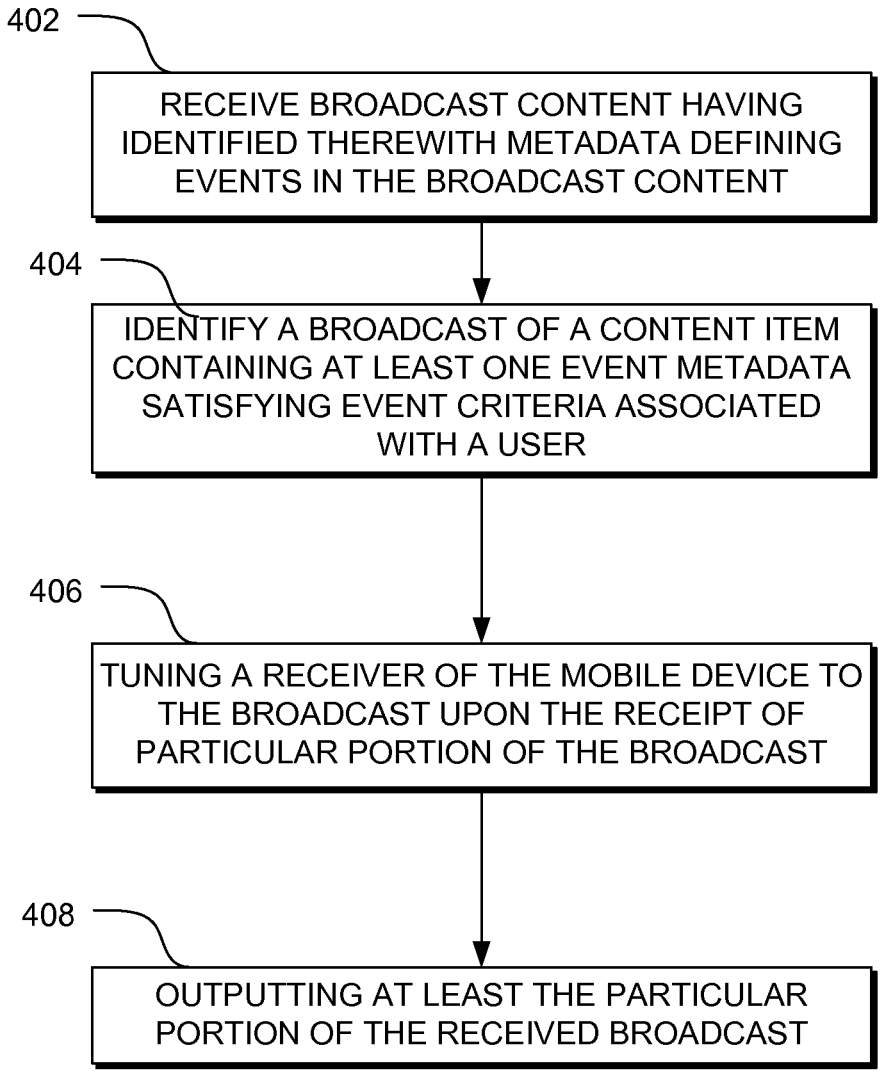
FIG. 4
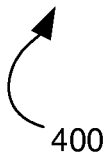

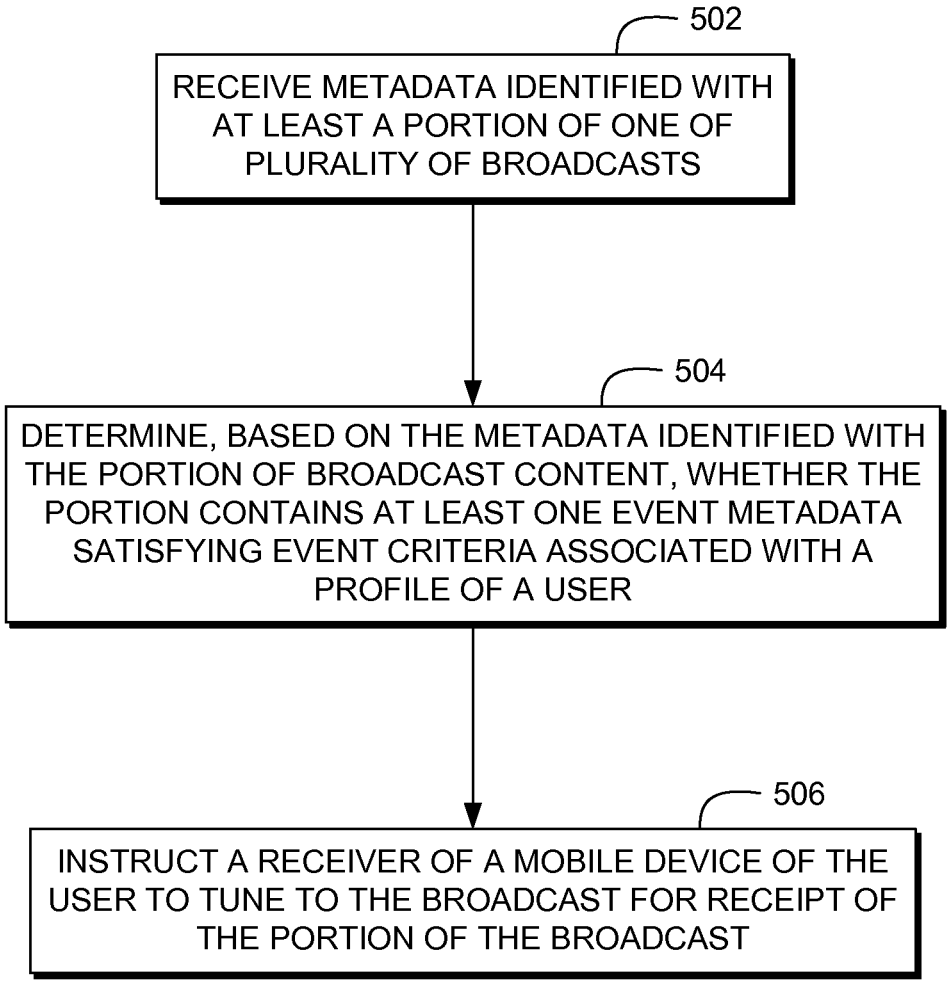
*FIG. 5*
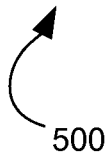

METHOD AND SYSTEM OF ACTIVATING DISPLAY OF MULTIMEDIA DATA ON A MOBILE DEVICE

RELATED APPLICATIONS

This application relates generally to communications, and more specifically, to communication of multimedia data.

BACKGROUND

Electronic devices such as mobile telephone handsets and other mobile devices may be configured to receive broadcasts of sports, entertainment, informational programs, or other multimedia content items. For example, audio and/or video data may be communicated using a broadband broadcast communications link to the electronic devices. There is a need to provide a person an enhanced viewing experience on such devices.

SUMMARY

The system, method, and devices of the invention each have several aspects, no single one of which is solely responsible for its desirable attributes. Without limiting the scope of this invention as expressed by the claims which follow, its more prominent features will now be discussed briefly. After considering this discussion, and particularly after reading the section entitled "Detailed Description of Certain Embodiments" one will understand how the features of this invention provide advantages that include an enhanced user interface providing customized multimedia access including providing a way to alert users to particular portions of broadcast content during the broadcast.

BRIEF DESCRIPTION OF THE DRAWINGS

FIG. 3 illustrates an example of a user interface for display on the device of FIG. 2.

FIG. 4 is a flowchart illustrating an example of a method of accessing broadcast content in a system such as illustrated in FIG. 1.

FIG. 5 is a flowchart illustrating another example of a method of accessing broadcast content in a system such as illustrated in FIG. 1.

DETAILED DESCRIPTION

Figure 1:
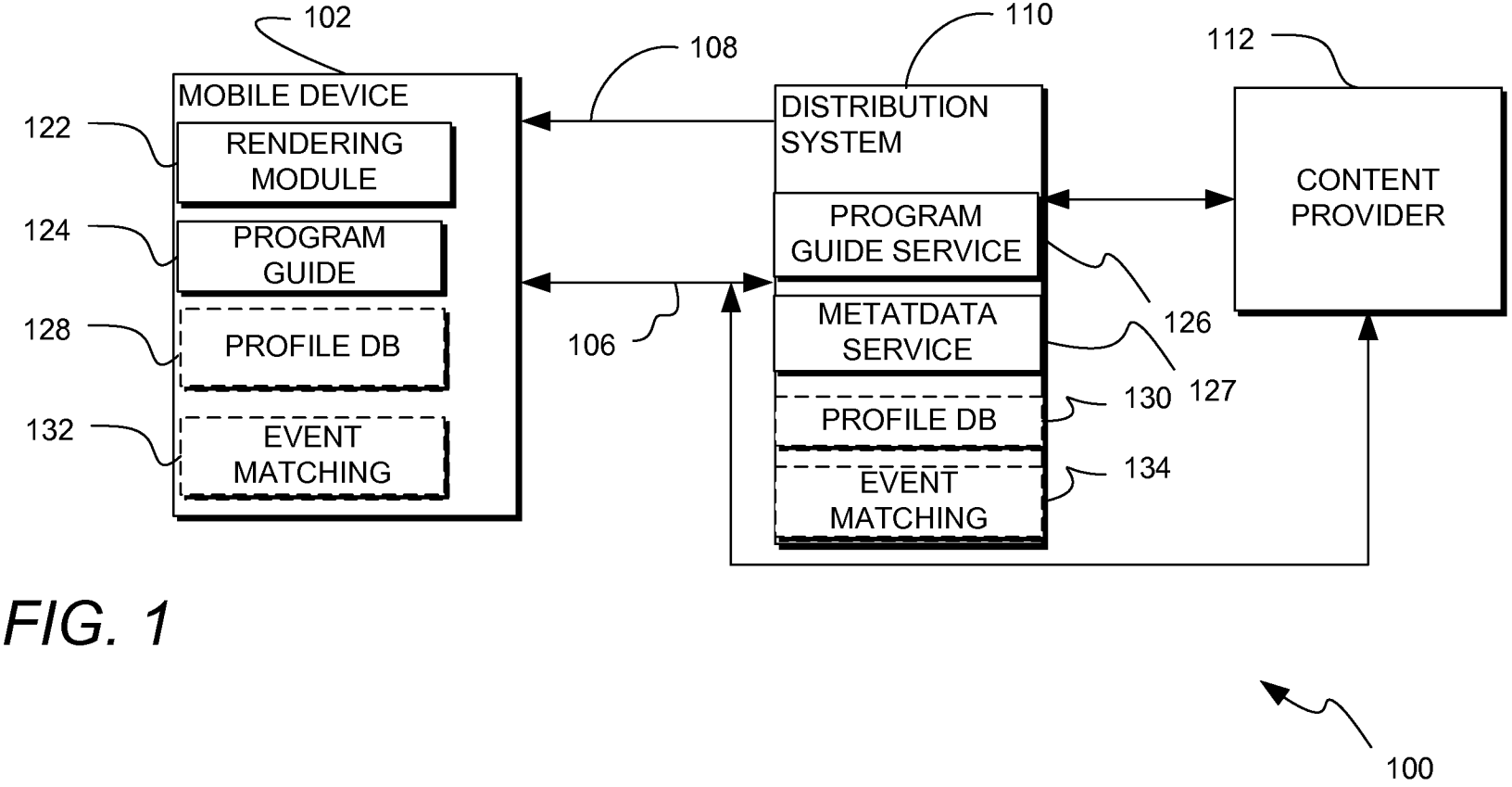
FIG. 1 is a block diagram illustrating an example system for providing broadcast programming.

The following detailed description is directed to certain specific aspects of the invention. However, the invention can be embodied in a multitude of different ways, for example, as defined and covered by the claims. It should be apparent that the aspects herein may be embodied in a wide variety of forms and that any specific structure, function, or both being disclosed herein is merely representative. Based on the teachings herein one skilled in the art should appreciate that an aspect disclosed herein may be implemented independently of any other aspects and that two or more of these aspects may be combined in various ways. For example, an apparatus may be implemented or a method may be practiced using any number of the aspects set forth herein. In addition, such an apparatus may be implemented or such a method may be practiced using other structure, functionality, or structure and functionality in addition to or other than one or more of the aspects set forth herein.

Multimedia communications technologies enable users to receive video or other programming. Program guides provide a way for users to identify and select content of interest. However, program guides generally do not have updated data regarding the actual content that is broadcast, but rather, include a general description of the content. For example, regularly broadcast news programs generally do not include a detailed description of their content in the program guide as the content may not be set until the time of the broadcast. Similarly, unscheduled broadcasts may include particular content that could not be identified in time for inclusion in a program guide. Moreover, even where a program guide may include details of the particular content, the timing of such content within the broadcast may not be identifiable based on the program guide information. For example, a news show may have a program guide entry that lists the subjects to be covered but not their particular order and timing within the broadcast.

Desirably, one embodiment provides a way of alerting users to portions of broadcasts content having metadata matching a profile of the user, and in one embodiment, tuning a receiver of the user's mobile device to the portion of the broadcast. Embodiments can be used to provide users with access to information such as weather or other news alerts, or to any other type of content. In one embodiment, metadata indicative of events corresponding to portions of the content are matched to a user profile. The metadata may include information about events in the content items that identifies particular portions of the content items. Moreover, a user can view live events, unscheduled events, or events that are defined by greater detail than is provided by program guides without constantly monitoring various broadcasts.

Thus, one embodiment provides a way for users to learn of, and view or listen to, broadcasts of content items related to favorite topics (news or score relating to particular sports stars, e.g., all news or scores relating to Tiger Woods, all broadcast debates of a particular political party ahead of an election). Rather than constantly monitoring a news channel broadcast, a user may, for example, have a profile that identifies particular types of news events of interest such that one embodiment of the system identifies matching portions of content on a number of different news channels and tunes to the particular channel as the event is broadcast.

FIG. 1 is a block diagram illustrating an example system 100 for providing broadcast programming to mobile devices 102 from one or more content providers 112 via a distribution system 110. Although one mobile device 102 is shown in FIG. 1, examples of the system 100 may be configured to use any number of mobile devices 102. The distribution system 110 may receive data representing a multimedia content item from the content provider 112. The multimedia content items may be communicated over a wired or wireless content item communication link 108. In one embodiment, the communications link 108 is a high speed or broadband link. In one embodiment, the content provider 112 may communicate the content directly to the mobile device 102 (not shown in FIG. 1), bypassing the distribution system 110, via the communications link 108 or via another link. It is to be recognized that in other embodiments multiple content providers 112 may provide content items via multiple distribution systems 110 to the mobile devices 102 either by way of the distribution system 110 or directly.

In the example system 100, the content item communication link 108 is illustrated as a uni-directional network to each of the illustrated devices 102. However, the content item communication link 108 may also be a fully symmetric bi-directional network.

In the example system 100, the mobile devices 102 are also configured to communicate over a second communication link 106. In one embodiment, the second communication link 106 is a two way communication link. In the example system 100, however, the link 106 may also comprise a second link from the mobile device 102 to the distribution system 110 and/or the content provider 112. The second communication link 106 may also be a wireless network configured to communicate voice traffic and/or data traffic. The mobile devices 102 may communicate with each other over the second communication link 106. The communication link 106 may also communicate content item guide and other data between the distribution system 110 and the mobile devices 102.

The communication links 108 and 108 may comprise one or more wired and/or wireless links, including one or more of a Ethernet, telephone (e.g., POTS), cable, power-line, and fiber optic systems, and/or a wireless system comprising one or more of a code division multiple access (CDMA or CDMA2000) communication system, a frequency division multiple access (FDMA) system, a time division multiple access (TDMA) system such as GSM/GPRS (General Packet Radio Service)/EDGE (enhanced data GSM environment), a TETRA (Terrestrial Trunked Radio) mobile telephone system, a wideband code division multiple access (WCDMA) system, a high data rate (1xEV-DO or 1xEV-DO Gold Multicast) system, an IEEE 802.11 system, a MediaFLO system, a DMB system, an orthogonal frequency division multiple access (OFDM) system, or a DVB-H system.

In addition to communicating content to the mobile device 102, the distribution system 110 may also include a program guide service 126. The program guide service 126 receives programming schedule and content related data from the content provider 112 and/or other sources and communicates data defining an electronic programming guide (EPG) 124 to the mobile device 102. The EPG 124 may include data related to the broadcast schedule of multiple broadcasts of particular content items available to be received over the program communication link 108. The EPG data may include titles of content items, start and end times of particular broadcasts, category classification of programs (e.g., sports, movies, comedy, etc.), quality ratings, adult content ratings, etc. The EPG 124 may be communicated to the mobile device 102 over the program communication link 108 and stored on the mobile device 102.

In one embodiment, the distribution system 110 includes a metadata service 127 that provides metadata defining events in all or portions of content items. For example, the metadata service 127 may provide metadata that is indicative of events in portions of content items. For example, the metadata may indicate particular classes of events such as reporting of sports scores, weather reports, news reports including reports of particular types of events such as business or stock news, natural disasters, car chases, legal or criminal news, scientific breakthroughs, political news or events. The metadata may also include data indicative particular events on serialized programming such as daytime soap operas or other serialized content items. The metadata may also include information about specific entities to which (or to whom) portions of content items relate. For example, the metadata may indicate news about particular sports players, celebrities, politicians, particular companies (e.g., including a company's stock ticker symbol), particular places associated with the content items, etc. In one embodiment, the metadata is generated automatically based on one or more of the program guide data, closed captioning data, or other data associated with the content. In one embodiment, the metadata service 127 receives the metadata or information about events in content items from the content provider 112, either in information received with the content items or via a separate communications channel. In one embodiment, the content provider provides weather or other public alerts that are converted to metadata by the metadata service in association with a related content item, e.g., a news show. In one embodiment, the metadata service 127 may receive the metadata from one or more human operators who enter data based on reviewing the content items. The reviewing may provide metadata for live broadcasts as a live content item is broadcast.

One or both of the mobile device 102 and the distribution system 110 may include a local profile database 128 (on the mobile device 102) and/or a server profile database 130 on the distribution system 110. The profile databases 128 and 130 store event user profiles that include one or more triggers or criteria for identifying events of interest to the user of particular mobile devices from the metadata. The user profiles may include logical rules or heuristics relating metadata to a particular user. The user profiles may be based on content or event preferences provided by the user through a user interface screen of the mobile device 102 or via another interface such as a web page provided by the distribution system 110. The user profiles may also be based on content items previously viewed by the user on the mobile device 102. For example, profiles may include a weighting of metadata or criteria that match frequently viewed content items or frequently viewed portions of content items. For example, if a user tends to watch portions of news programs having sports news (e.g., content items having metadata identifying portions as sports), the profile for that user may increase the weight of sports news related metadata. In one embodiment, the server profile database 130 may synchronize a user's profile with one or more of the mobile devices 102 that are associated with the user so that the user's profile is not lost if the memory of the mobile device 102 is reset or if the user switches mobile devices 102.

In one embodiment, the mobile device 102 includes an event matching module 132 that processes received metadata and compares it to one or more user profiles or processes the metadata based on the user profiles in the profile database 128 and instructs the mobile device 102 to tune to matching content items, to store (and thus record) the content item, or to otherwise notify the user of the match. In one embodiment, the distribution system 110 includes an event matching service 134 to perform the matching function in server computers of the distribution system 110 using profile data from the profile database 130 and provide instructions to the mobile device 102 based on the match. One embodiment includes both the event matching module 132 of the mobile device and the event matching service 134 of the server. In one such embodiment, certain types of metadata or profile data are processed on the server module 134 and certain metadata or profile data is processed on the mobile device 102. It is to be recognized, however, that other embodiments may include a single event matching module 132 or matching service 134. In one embodiment, some mobile devices 102 may include the event matching module 132 (e.g., devices with more powerful processing) while other devices 102 (e.g., with less powerful processing capabilities) may rely on the matching module of the distribution system 110.

The mobile device 102 may also include a rendering module 122 configured to render the multimedia content items received over the content item communication link 108. The rendering module 122 may include analog and/or digital technologies. The rendering module 122 may include one or more multimedia signal processing systems, such as video encoders/decoders, using encoding/decoding methods based on international standards such as MPEG-x and H.26x standards. Such encoding/decoding methods generally are directed towards compressing the multimedia data for transmission and/or storage.

Figure 2:
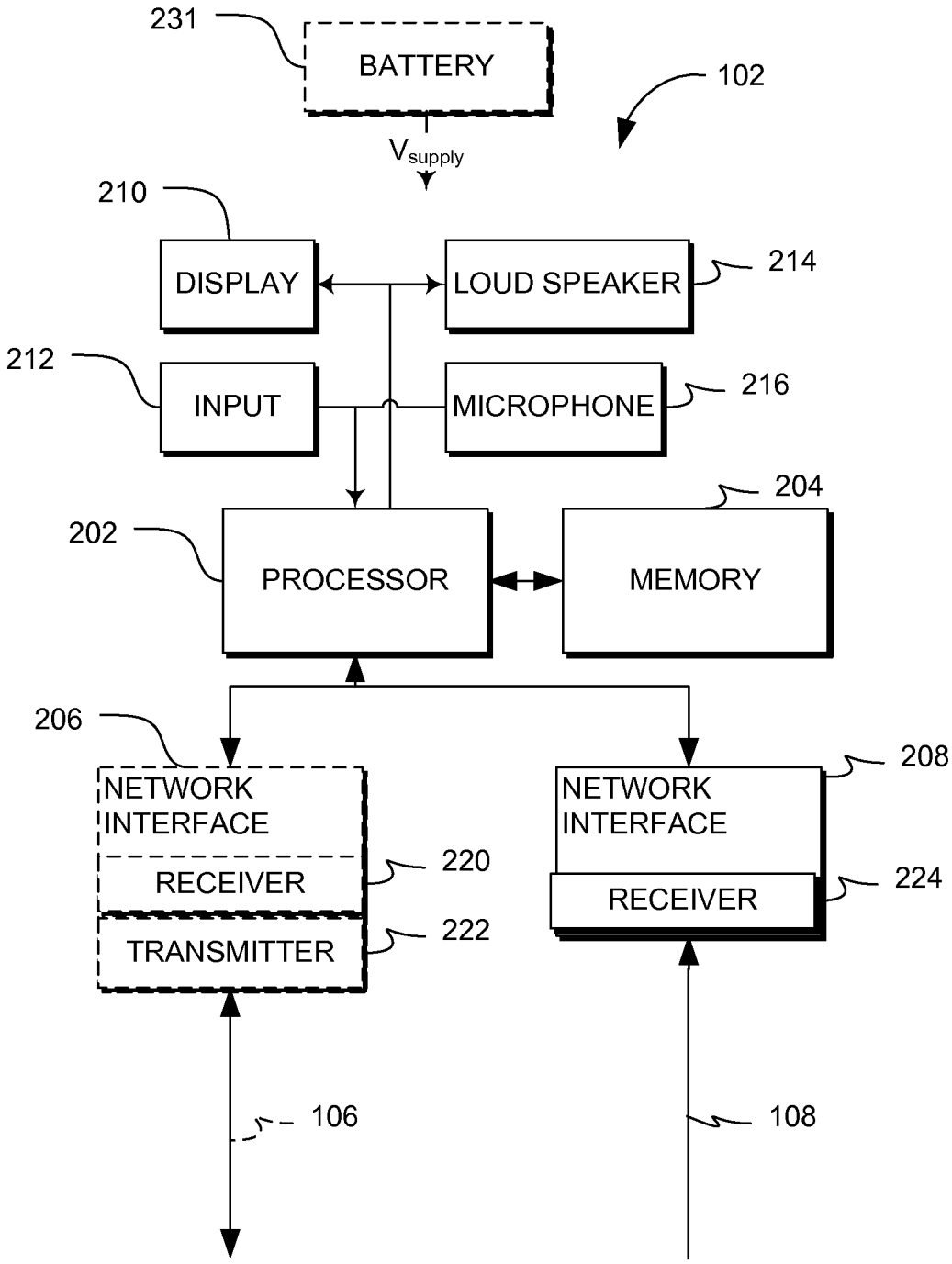
FIG. 2 is a block diagram illustrating an example of a mobile device such as illustrated in FIG. 1.

FIG. 2 is a block diagram illustrating an example of one of the mobile devices 102 such as illustrated in FIG. 1. The device 102 includes a processor 202 that is in communication with a memory 204 and a network interface 208 that communicates over the program communication link 108. The network interface 208 includes a receiver 224 configured to receive the unidirectional program communication link 108. The network interface 208 and receiver 224 may receive signals according to wired technologies including Ethernet, telephone (e.g., POTS), cable, power-line, and fiber optic systems, and/or wireless technologies comprising one or more of a code division multiple access (CDMA or CDMA2000) communication system, a frequency division multiple access (FDMA) system, a time division multiple access (TDMA) system such as GSM/GPRS (General Packet Radio Service)/EDGE (enhanced data GSM environment), a TETRA (Terrestrial Trunked Radio) mobile telephone system, a wideband code division multiple access (WCDMA) system, a high data rate (1xEV-DO or 1xEV-DO Gold Multicast) system, an IEEE 802.11 system, a MediaFLO system, a DMB system, an orthogonal frequency division multiple access (OFDM) system, or a DVB-H system.

The mobile device 102 may include an optional second network interface 206 for communicating via the second bi-directional communication link 106. The network interface 206 may include any suitable antenna (not shown), a receiver 220, and a transmitter 222 so that the exemplary device 102 can communicate with one or more devices over the second communication link 106. Optionally, the network interface 206 may also have processing capabilities which reduce processing requirements of the processor 202.

The device 102 may also include one or more of a display 210, a user input device 212 such as a key, touch screen, or other suitable tactile input device, a loudspeaker 214 comprising a transducer adapted to provide audible output based on a signal received over the communication link 106 and/or a microphone 216 comprising a transducer adapted to provide audible input of a signal that may be transmitted over one or both of the communication links 106 and 108. In one embodiment, the input device 212 comprises an accelerometer or other device configured to detect movement of the device.

The device 102 may optionally include a battery 231 to provide power to one or more components of the device 102. The device 102 may comprise at least one of a mobile handset, a personal digital assistant, a laptop computer, a headset, a vehicle hands free device, or any other electronic device. For example, one or more aspects taught herein may be incorporated into a phone (e.g., a cellular phone), a personal data assistant ("PDA"), an entertainment device (e.g., a music or video device), a headset (e.g., headphones, an earpiece, etc.), a microphone, or any other suitable device.

The device 102 may be implemented in a variety of ways. Referring to FIG. 2, the device or apparatus 102 is represented as a series of interrelated functional blocks that may represent functions implemented by, for example the processor 202, software, some combination thereof, or in some other manner as taught herein. For example, the processor 202 may facilitate user input via the input devices 212. Further, the transmitter 222 may comprise a processor for transmitting that provides various functionalities relating to transmitting information to another device 102. The receiver 220 may further comprise a processor that provides various functionality relating to receiving information from another device 102.

The device 102 may be configured to receive data concurrently from one or both of the communication links 106 and 108. For example, the processor 202 may be incapable of performing the receiving and/or transmitting functions of the bidirectional network interface 206 at the same time that the broadband unidirectional interface 208 is receiving over the program communication link 108. Thus, for example, in one embodiment, reception or display of a broadcast of a program may be discontinued over the program communication link 108 when a signal, e.g., a telephone call for example, is received over the communication link 106.

The device 102 may be implemented using any suitable combination of the functions and components discussed with reference to FIG. 2. In one example of the device 102, the device 102 may comprise one or more integrated circuits. Thus, such integrated circuits may comprise one or more processors that provide the functionality of the processor 202 illustrated in FIG. 2. The integrated circuit may comprise other types of components that implement some or all of the functionality of the illustrated processor components. Further, one or more processors may implement the functionality of the illustrated processor components.

FIG. 3 illustrates an example of a user interface 300 displayed on the display 210 of the mobile device 102 for selecting events of interest to a particular user of the mobile device 102. In one embodiment, the user interface 300 allows users of the device 102 to edit a user profile of the profile database 128 of the mobile device 102. In another embodiment, the user interface 300 allows users of the device 102 to edit a user profile of the profile database 130 of the distribution system 110. The example interface 300 illustrates a hierarchy of events that the user may select to add (or deselect to remove) from their profile. For example, the user can select high level events such as "News" or "Sports" so that there device 102 tunes to such content whenever metadata defining such events is received. To better focus on content items of interest to the viewer, subcategories of events such as "News" events such as "Live Events," "Reports," or "Weather" may be selected. More detailed subcategories such as "Celebrities" may further include a text entry box or submenu (not shown) for selecting particular celebrities. Thus, a user may enter or select one or more names such as "Thomas Jefferson" and be notified of news reports related to Thomas Jefferson. Other categories of events may also have associated filter data, e.g., the "Weather" category may be associated with a zip code or region of interest to the user. The information from the user interface 300, or other sources of user profile information such as past viewed data, may be stored in the user profile database 128 or 130 in any suitable format or data structure. For example, the events may be stored in a user profile as text or other data indicative of text of a particular category that can be matched to the metadata provided by the metadata service 127.

FIG. 4 is a flowchart illustrating an example of a method 400 of receiving at least portions of content items having events that match a user profile such as in the example system 100. The method 400 begins at a block 400 in which the processor 202 of the mobile device 102 receives broadcast content having identified therewith metadata defining events in the broadcast content.

Moving to a block 404, the processor 202 identifies a broadcast of a content item containing at least one event metadata satisfying event criteria associated with a user. In one embodiment, the processor 202 identifies, via event the matching module 132, the broadcast by processing or comparing the metadata with user profile data from the profile database 128 of a user of the mobile device 102. Next at a block 406, the processor 202 tunes a receiver, e.g., the receiver 224 or the receiver 222, to the broadcast upon the receipt of particular portion of the broadcast. In one embodiment, the metadata may be received prior to the particular portion of the broadcast, thus the processor 202 may wait to tune the receiver until the particular portion of the content item is broadcast.

Proceeding to a block 408, the processor 202 may output at least the particular portion of the received broadcast for display. In one embodiment, the rendering module 122 receives the output portion of the broadcast, decodes, and renders the broadcast content to the display 210 and/or the loudspeaker 214 of the mobile device 102.

In one embodiment, the mobile device 102 may render the content while providing a user interface for the user of the mobile device to discontinue display of the broadcast content based on user input. In one embodiment, the mobile device 102 renders the broadcast content for a specified time period during which the user may confirm that they wish to continue rendering of the content and discontinue based on a lack of user input such as via the input device 212. Thus, the mobile device 102 can being rendering the content automatically upon receipt but will discontinue rendering if the user does not provide feedback for the rendering to continue (as may occur if the device 102 is not in proximity to the user or otherwise not being used) in order to save power when the user does not express interest in the broadcast.

It is to be recognized that depending on the embodiment, certain acts or events of any of the methods described herein can be performed in a different sequence, may be added, merged, or left out all together (e.g., not all described acts or events are necessary for the practice of the method). Moreover, in certain embodiments, acts or events may be performed concurrently, e.g., through multi-threaded processing, interrupt processing, or multiple processors, rather than sequentially.

In one embodiment, the distribution system 110, for example, as embodied in the profile database 130 and/or event matching service 134 may perform some or all of the acts associated with the method 400.

For example, FIG. 5 is a flowchart illustrating an example of a method 500 of accessing at least portions of content items having events that match a user profile such as in the example system 100. In particular, the method 500 begins at a block 502 in which the metadata service 127 of the distribution system 110 provides metadata identified with at least a portion of one of plurality of broadcasts that is received by the event matching service 134.

Next at a block 504, the event matching service 134 determines, based on the metadata identified with the portion of broadcast content, whether the portion contains at least one event metadata satisfying event criteria associated with a profile of a user. Proceeding to a block 506, the event matching service 134 instructs a receiver of a particular mobile device 102 of the user to tune to the broadcast for receipt of the portion of the broadcast. The event matching service 134 may communicate the instruction over one, or both, of the communication links 106 and 108. In one embodiment, the matching service 134 may further instruct the mobile device 102 to provide a notification that the received content is available for playback on the mobile device 102.

In view of the above, one will appreciate that the disclosure addresses how to enable users to receive desired content. For example, the illustrated aspects may provide a method and apparatus of automatically tuning a mobile device to particular portions of content of interest to the user. In one embodiment, such portions include content events that are identified during the broadcast. In one embodiment, the portions include content events that are identified based on metadata provided in association with the content and which may be based on live content, or content that is not fully described in complete or fine grained detail by electronic guide data.

Those skilled in the art will recognize that the various illustrative logical blocks, modules, circuits, and algorithm steps described in connection with the aspects disclosed herein may be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of this disclosure.

For example, any illustrative logical blocks, modules, and circuits described in connection with the aspects disclosed herein may be implemented within or performed by an integrated circuit ("IC"), an access terminal, or an access point. The IC may comprise a general purpose processor, a digital signal processor (DSP), an application specific integrated circuit (ASIC), a field programmable gate array (FPGA) or other programmable logic device, discrete gate or transistor logic, discrete hardware components, electrical components, optical components, mechanical components, or any combination thereof designed to perform the functions described herein, and may execute codes or instructions that reside within the IC, outside of the IC, or both. A general purpose processor may be a microprocessor, but in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration.

The steps of a method or algorithm described in connection with the aspects disclosed herein may be embodied directly in hardware, in a software module executed by a processor, or in a combination of the two. A software module may reside in RAM memory, flash memory, ROM memory, EPROM memory, EEPROM memory, registers, hard disk, a removable disk, a CD-ROM, or any other form of storage medium known in the art. An exemplary storage medium is coupled to the processor such the processor can read information from, and write information to, the storage medium. In the alternative, the storage medium may be integral to the processor. The processor and the storage medium may reside in an ASIC. The ASIC may reside in a user terminal. In the alternative, the processor and the storage medium may reside as discrete components in a user terminal.

While the above detailed description has shown, described, and pointed out novel features of the invention as applied to various aspects, it will be understood that various omissions, substitutions, and changes in the form and details of the device or process illustrated may be made by those skilled in the art without departing from the scope of this disclosure. As will be recognized, the invention may be embodied within a form that does not provide all of the features and benefits set forth herein, as some features may be used or practiced separately from others. The scope of this disclosure is defined by the appended claims, the foregoing description, or both. All changes which come within the meaning and range of equivalency of the claims are to be embraced within their scope.

What is claimed is:

1. A method of receiving multimedia data on a mobile device, the method comprising:

receiving broadcast content, the broadcast content comprising information about broadcasts and metadata defining events corresponding to the broadcasts;

identifying information about a broadcast associated with at least one event metadata satisfying event criteria associated with a user, wherein the at least one event metadata is configured to identify at least a particular portion of a content item in the broadcast;

tuning a receiver of the mobile device to the broadcast at the particular portion of the content item in the broadcast corresponding to the at least one event metadata, wherein the particular portion of the content item is identified prior to the tuning of the receiver to receive the broadcast;

outputting at least the particular portion of the content item in the received broadcast; and discontinuing the outputting of the content item based on a lack of user input within a selected time period.

2. The method of claim 1, further comprising receiving the metadata defining events.

3. The method of claim 2, wherein the receiving is during the broadcast of the broadcast content.

4. The method of claim 2, wherein identifying the broadcast comprises comparing the received metadata to a profile of the user, the profile comprising the event criteria.

5. The method of claim 2, wherein receiving the metadata comprises receiving the metadata on the mobile device, and wherein the identifying is performed by the mobile device.

6. The method of claim 4, wherein receiving the metadata comprises receiving the metadata on a server, and wherein the comparing is performed by the server.

7. The method of claim 1, wherein the metadata comprises at least one category associated with the particular portion of the content item.

8. The method of claim 1, further comprising receiving user input indicative of whether to continue outputting the broadcast.

9. The method of claim 8, further comprising discontinuing outputting of the content item based on the user input.

10. The method of claim 8, wherein receiving the user input comprises sensing movement of the mobile device.

11. The method of claim 8, wherein receiving the user input comprises receiving at least one of a touch screen interaction or keypress.

12. The method of claim 1, wherein outputting the received content item comprises playing the received content.

13. The method of claim 12, wherein playing the received content item comprises decoding the received content item; and outputting the decoded content item via at least one of a display and a speaker.

14. The method of claim 1, wherein outputting the received content item comprises outputting the received content item to a storage electrically attached to the mobile device.

15. The method of claim 14, further comprising providing a notification that the received content item is available for playback on the mobile device.

16. The method of claim 15, wherein the notification comprises at least one of displaying information and outputting a sound.

17. A device for accessing content items, comprising:

a receiver configured to receive broadcast content, the broadcast content having identified therewith metadata defining events in the broadcast content;

a storage configured to store at least one profile for accessing multimedia content items; and a processor configured to:

identify a broadcast of a content item having identified therewith at least one event metadata satisfying event criteria associated with a user, wherein the at least one event metadata is configured to identify at least a particular portion of the content item in the broadcast;

tune the receiver to the broadcast at the particular portion of the content item in the broadcast having identified therewith the at least one event metadata, wherein the particular portion of the content item in the broadcast is identified prior to the receiver being tuned to receive the content item in the broadcast;

output at least the particular portion of the content item in the received broadcast;

discontinue output of the content item based on a lack of user input; and identify the lack of user input based on lack of user input within a selected time period.

18. The device of claim 17, wherein the processor is further configured to: decode the particular portion of the content item in the broadcast; and output the decoded portion via at least one of a display and a speaker.

19. The device of claim 17, wherein the processor is configured to output the particular portion of the broadcast to the storage, and wherein the storage is further configured to store the output portion.

20. The device of claim 19, wherein the processor is configured to provide a notification that the stored portion is available for playback on the mobile device.

21. The device of claim 20, wherein the processor is configured to provide the notification by at least one of displaying information and outputting a sound.

22. A device for accessing content items, comprising:

means for receiving broadcast content, the broadcast content having identified therewith metadata defining events in the broadcast content;

means for storing at least one profile for accessing multimedia content items; and means for processing, the processing means configured to:

identify a broadcast of a content item having identified therewith at least one event metadata satisfying event criteria associated with a user, wherein the at least one event metadata is configured to identify at least a particular portion of the content item in the broadcast;

tune the receiving means to the broadcast at the particular portion of the content item in the broadcast having identified therewith the at least one event metadata, wherein the particular portion of the content item in the broadcast is identified prior to the receiver being tuned to receive the content item in the broadcast;

output at least the particular portion of the content item in the received broadcast;

discontinue output of the content item based on a lack of user input; and identify the lack of user input based on lack of user input within a selected time period.

23. The device of claim 22, further comprising means for rendering the output portion of the broadcast.

24. A computer-program product, comprising:

a computer readable medium comprising codes executable by at least one processor of a mobile device to:

receive broadcast content, the broadcast content having identified therewith metadata defining events in the broadcast content;

identify a broadcast of a content item having identified therewith at least one event metadata satisfying event criteria associated with a user, wherein the at least one event metadata is configured to identify at least a particular portion of the broadcast content;

tune a receiver of the mobile device to the broadcast at the particular portion of the broadcast containing the at least one event metadata, wherein the identified particular portion of the broadcast content is identified prior to the receiver being tuned to receive the broadcast;

output at least the particular portion of the received broadcast discontinue output of the content based on a lack of user input; and identify the lack of user input based on lack of user input within a selected time period.

* * * * *